US007874071B2

(12) United States Patent
Tobler

(10) Patent No.: US 7,874,071 B2
(45) Date of Patent: Jan. 25, 2011

(54) METHOD OF MAKING AN ICE DISPENSE AGITATOR

(76) Inventor: Andrew J. Tobler, 2532 Elder La., Franklin Park, IL (US) 60131

( * ) Notice: Subject to any disclaimer, the term of this patent is extended or adjusted under 35 U.S.C. 154(b) by 1343 days.

(21) Appl. No.: 11/384,561

(22) Filed: Mar. 20, 2006

(65) Prior Publication Data

US 2006/0156526 A1 Jul. 20, 2006

Related U.S. Application Data

(63) Continuation-in-part of application No. 10/812,370, filed on Mar. 29, 2004, now abandoned.

(60) Provisional application No. 60/462,163, filed on Apr. 10, 2003.

(51) Int. Cl.

| | |
|---|---|
| ***B01F 7/00*** | (2006.01) |
| ***B02C 1/10*** | (2006.01) |
| ***B02C 17/20*** | (2006.01) |
| ***B21D 53/78*** | (2006.01) |
| ***B21K 25/00*** | (2006.01) |
| ***B63H 1/26*** | (2006.01) |

(52) U.S. Cl. ..... 29/889.23; 29/889; 29/412; 29/417; 241/282.1; 241/292.1; 366/325.92; 366/330.1; 366/330.3; 366/343; 416/237

(58) Field of Classification Search ..... 29/412, 29/417, 34 R; 72/338, 379.2; 220/4.12; 241/282, 282.1, 282.2, 292.1; 366/325.4, 366/325.92, 327.1, 327.3, 327.4, 329.1, 330.1, 366/330.3, 337, 343; 416/199, 223 R, 228, 416/235, 237

See application file for complete search history.

(56) References Cited

U.S. PATENT DOCUMENTS

| | | | | |
|---|---|---|---|---|
| 167,493 | A | 9/1875 | Bright et al. | |
| 2,498,125 | A | 2/1950 | Knudsen et al. | |
| 3,030,083 | A | 4/1962 | Stiffler | |
| 3,147,958 | A | 9/1964 | Stiffler | |
| 4,087,079 | A | 5/1978 | Kramer | |
| 4,260,267 | A | 4/1981 | Walton | |
| 5,226,783 | A | 7/1993 | Mita | |
| 5,247,825 | A * | 9/1993 | Erickson | 72/339 |
| 2004/0213082 | A1 | 10/2004 | Tobler | |

FOREIGN PATENT DOCUMENTS

| | | | |
|---|---|---|---|
| DE | 3730423 | A1 | 3/1989 |

* cited by examiner

*Primary Examiner*—David P Bryant
*Assistant Examiner*—Alexander P Taousakis
(74) *Attorney, Agent, or Firm*—Pyle & Piontek, LLC

(57) ABSTRACT

A method of making an ice dispense agitator of a type as may be used in ice and beverage dispensing machines is characterized by manufacturing the agitator as an integral unit by cutting the agitator from flat metal stock and then bending the agitator into a desired final shape.

8 Claims, 4 Drawing Sheets

METHOD OF MAKING AN ICE DISPENSE AGITATOR

This application is a continuation-in-part of application Ser. No. 10/812,370, filed Mar. 29, 2004 now abandoned, and claims benefit of provisional application Ser. No. 60/462,163, filed Apr. 10, 2003.

BACKGROUND OF THE INVENTION

The present invention relates generally to ice dispensing equipment, and in particular to ice dispensing equipment utilizing a rotating agitator for moving and dispensing the ice.

Ice dispensing equipment is well known and generally employs an ice retaining bin and an ice chute that is placed in communication with ice in the bin through an electrically operated gate. Ice is dispensed from the bin by opening the gate for a flow of ice from the bin into, through and out of the chute into a suitable receptacle, such as a cup for a beverage. Ice dispensing is typically initiated by actuation of a switch that operates an electrically driven dispensing mechanism that includes and opens the gate, usually until the switch is de-actuated. Also known is equipment that combines in a single unit dispensing of a beverage with an ice retaining and dispensing capacity.

All such equipment for dispensing ice either alone or together with a beverage customarily has an auger or agitator structure in the ice retaining bin that is rotated by a drive motor both during dispensing of ice and periodically. The agitator serves two primary purposes, in that it agitates the ice in the bin to prevent agglomeration and congealing of the discrete particles of ice into a mass of ice and it serves as part of the dispensing mechanism by moving the ice particles through the gate to and into the ice dispensing chute. Agitator assemblies include various arm extensions for agitating and breaking up the ice as the agitator rotates, as well as ice sweeping arm extensions having paddle or scoop ends. The scoop ends provide for contacting and lifting of the ice in the storage bin off of the bottom of the bin to an elevated ice outlet opening controlled by the gate for dispensing of the ice by gravity flow down the dispensing chute. Due to the plurality of ice breaking and sweeping arms, agitator assemblies can be relatively expensive to manufacture, in that they require the welding together of various separate components. Additionally, the assembly of an agitator must be done in a manner that provides for a robust and durable structure. Accordingly, it would be desirable to have an agitator assembly that can not only easily and inexpensively be manufactured, but also that as manufactured is in use sufficiently strong and not prone to deformation or breakage that would negatively impact its performance.

OBJECTS OF THE INVENTION

An object of the present invention is to provide a method for manufacturing an ice dispensing agitator that is easily and inexpensively fabricated from flat metal stock by cutting and bending operations.

Another object is to provide such a method, which requires minimal welding in the manufacture of an agitator, yet yields an agitator that is strong and not prone to breakage, deformation and damage in use.

SUMMARY OF THE INVENTION

In accordance with the present invention, a method of making an ice dispense agitator comprises the steps of cutting a unitary agitator body from flat metal stock to provide the unitary agitator body with a central hub and a plurality of ice sweeping arms extending outward from the central hub; and bending the ice sweeping arms to desired configurations. The cutting and bending steps may be performed either in a single operation or in separate operations. In performing the bending step, a portion of an outer end of each ice sweeping arm is bent to form an ice moving paddle and the cutting step provides the unitary agitator body with at least one ice agitating blade that is coplanar with and extends outward from an associated one of the ice sweeping arms, with the bending step also bending the at least one ice agitating blade out of coplanar relationship with its associated ice sweeping arm. Advantageously, the cutting step provides the at least one ice agitating blade with a flange portion having an end edge portion, and the bending step bends the flange portion to extend the end edge portion along and adjacent a portion of the associated ice sweeping arm, and for added strength and durability included is the step of welding the end edge portion to the associated ice sweeping arm.

Various techniques are contemplated for performing the step of cutting the unitary agitator body from sheet metal stock, including laser cutting water jet cutting, plasma cutting, milling, sawing, stamping, die cutting and computer numeric controlled machine punching. Another technique is to perform the cutting and bending steps in a single operation using a stamping and forming die.

In accordance with a another practice of the method of making an ice dispense agitator, included are the steps of cutting a unitary agitator body from flat metal stock to provide the unitary agitator body with coplanar elements including a central hub having an axis of rotation, a plurality of elongate ice sweeping arms extending radially outward from the hub in angular spaced relationship, and at least one elongate ice agitating blade extending outward from a side edge of an associated ice sweeping arm; bending a portion of an outer end of at least one ice sweeping arm to form an ice moving paddle on the outer end of the at least one ice sweeping arm; and bending the at least one ice agitating blade out of coplanar relationship with its associated ice sweeping arm. The step of bending the at least one ice agitating blade brings the plane of the ice agitating blade into generally transverse relationship with the plane of the associated ice sweeping arm, and included are the further steps of bending the at least one ice agitating blade along its length to an L-shape, such that one leg of the L-shaped blade has an end edge portion that extends over and adjacent the associated one of the ice sweeping arms, and welding the one edge portion to the associated ice sweeping arm. The step of bending a portion of an outer end of at least one ice sweeping arm to form an ice moving paddle on the outer end of the at least one ice sweeping arm advantageously comprises bending a portion of an outer end of each ice sweeping arm to form an ice moving paddle on the outer end each ice sweeping arm.

In accordance with a further practice of the method of making an ice dispense agitator, included are the steps of cutting a unitary agitator body from flat metal stock to provide the unitary agitator body with coplanar elements including a central hub having an axis of rotation, a plurality of elongate ice sweeping arms extending radially outward from the hub in angular spaced relationship and having end portions and transverse extensions at the end portions, and at least one elongate ice agitating blade extending transversely from a side of an associated one of the ice sweeping arms intermediate the hub and the end portion of the associated ice sweeping arm and having an end edge portion that extends along and adjacent the side of the associated ice sweeping arm; bending the end portion of each ice sweeping arm out of the plane of the part of the ice sweeping arm between the end portion and the central hub; bending the transverse extension of each ice sweeping arm out of the plane of the end portion of the ice sweeping arm; and bending the at least one ice agitating arm out of the plane of its associated ice sweeping arm. The unitary agitator body has an upper surface, the step of bending the end portion of each ice sweeping arm bends the end portion downward out of the plane of the part of the ice sweeping arm between the end portion and the central hub, the step of bending the transverse extension of each ice sweeping arm bends the transverse extension upward out of the plane of the end portion of the ice sweeping arm, and the step of bending the at least one ice agitating blade bends the at least one ice agitating blade upward out of the plane of its associated ice sweeping arm. The step of bending the end portion of each ice sweeping arm bends the end portion downward on the order of about 30° to 60° out of the plane of the part of the ice sweeping arm between the end portion and the central hub, the step of bending the transverse extension of each ice sweeping arm bends the transverse extension upward on the order of about 90° out of the plane of the end portion of the ice sweeping arm, and the step of bending the at least one ice agitating blade bends the at least one ice agitating blade upward on the order of about 90° out of the plane of its associated ice sweeping arm. The at least one ice agitating blade may comprises a plurality of ice agitating blades, each extending transversely from a side of an associated one of the ice sweeping arms, and included are the further steps of bending the at least one ice agitating blade along its length to be L-shaped, such that the bent leg of the L-shaped blade has the end edge portion and the end edge portion extends along and adjacent the associated one of the ice sweeping arms, and welding the end edge portion to the associated ice sweeping arm.

The foregoing and other objects, advantages and features of the invention will become apparent upon a consideration of the following detailed description, when taken in conjunction with the accompanying drawings.

DETAILED DESCRIPTION

Figure 1:
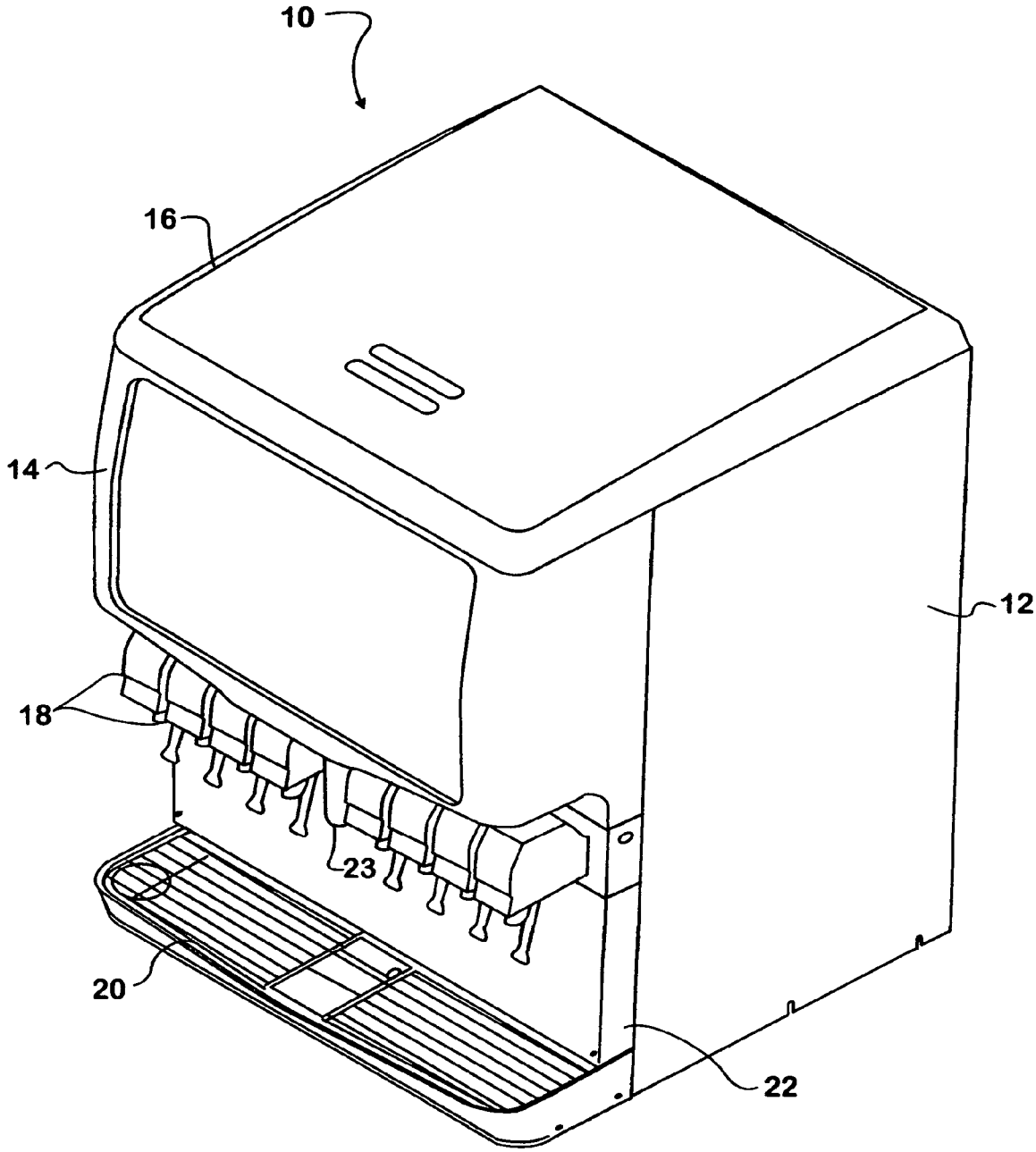
FIG. 1 is a perspective view of an ice/beverage dispenser of a type in which an agitator made according to a method of the present invention may be used.

The present invention provides an improved method of making an ice dispense agitator or auger that is particularly adapted for use in a combined ice and beverage dispensing machine of the general type shown in FIG. 1 and indicated generally at 10. As is conventional, the ice/beverage dispenser 10 includes an outer housing 12, a merchandising cover 14 and an ice bin cover 16 that is removable to open the top of the bin for filling of the bin with ice. A plurality of beverage dispensing valves 18 are secured to a front surface of the dispenser 10 above a drip tray 20 and adjacent to a splash panel 22. An ice dispensing chute 23 is also secured to the front surface of the dispenser centrally of the beverage dispensing valves 18 and above the drip tray 20.

Figure 2:
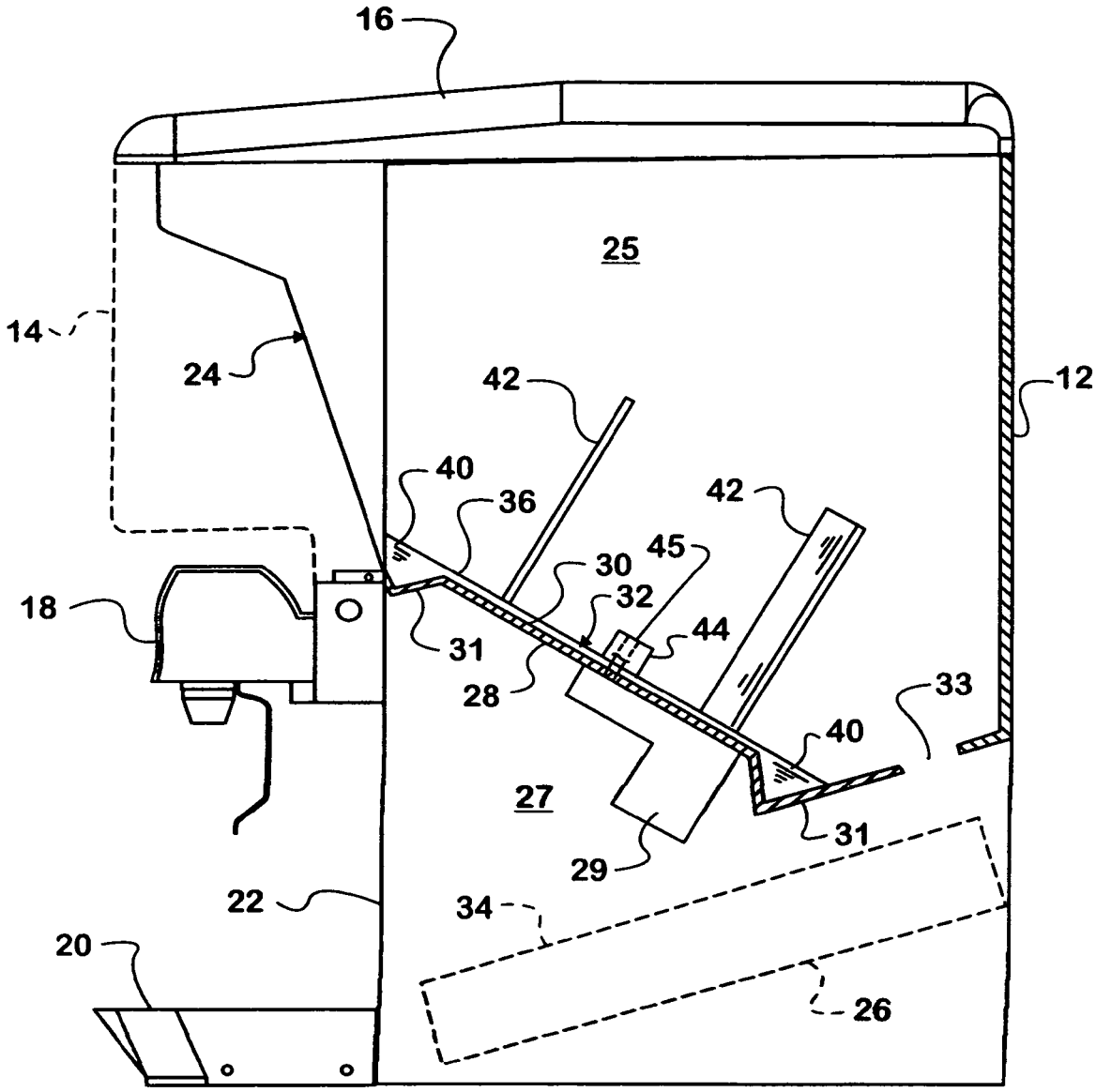
FIG. 2 is a partial cross-sectional side elevation view of the dispenser of FIG. 1 showing an agitator, made according to a method of the invention, positioned within an ice retaining bin of the dispenser.

With reference to FIG. 2, the ice/beverage dispenser 10 also includes a hopper or bin 24 defining therewithin an ice retaining compartment 25. A cold plate 26 is located in a lower compartment 27 beneath the ice bin 24, and the ice bin has a front wall 28 for mounting on its lower surface an agitator drive motor 29. An upper surface 30 of the wall 28, opposite from the agitator drive motor, is configured to define an annular ice directing trough 31. The drive motor 29 serves to rotate an ice dispense agitator or auger, indicated generally at 32, within the ice retaining compartment 25 of the ice bin 24, which agitator advantageously is manufactured according to a method of the present invention and serves to mix and agitate ice particles retained within the ice bin 24 to prevent congealing and agglomeration of the ice particles into a mass of ice, and also to move ice particles through the ice bin trough 31 to and through an outlet opening from the ice bin and into an open upper end of the chute 23 for gravitational flow of the ice downward through the chute and dispensing of the ice into a cup positioned beneath a lower outlet opening from the chute. Rotation of the agitator 32 also causes a portion of the ice retained within the ice bin 24 to fall through a bottom opening 33 in the wall 28 into the lower compartment 27 and onto a heat exchange top surface 34 of the cold plate 26.

Figure 3:
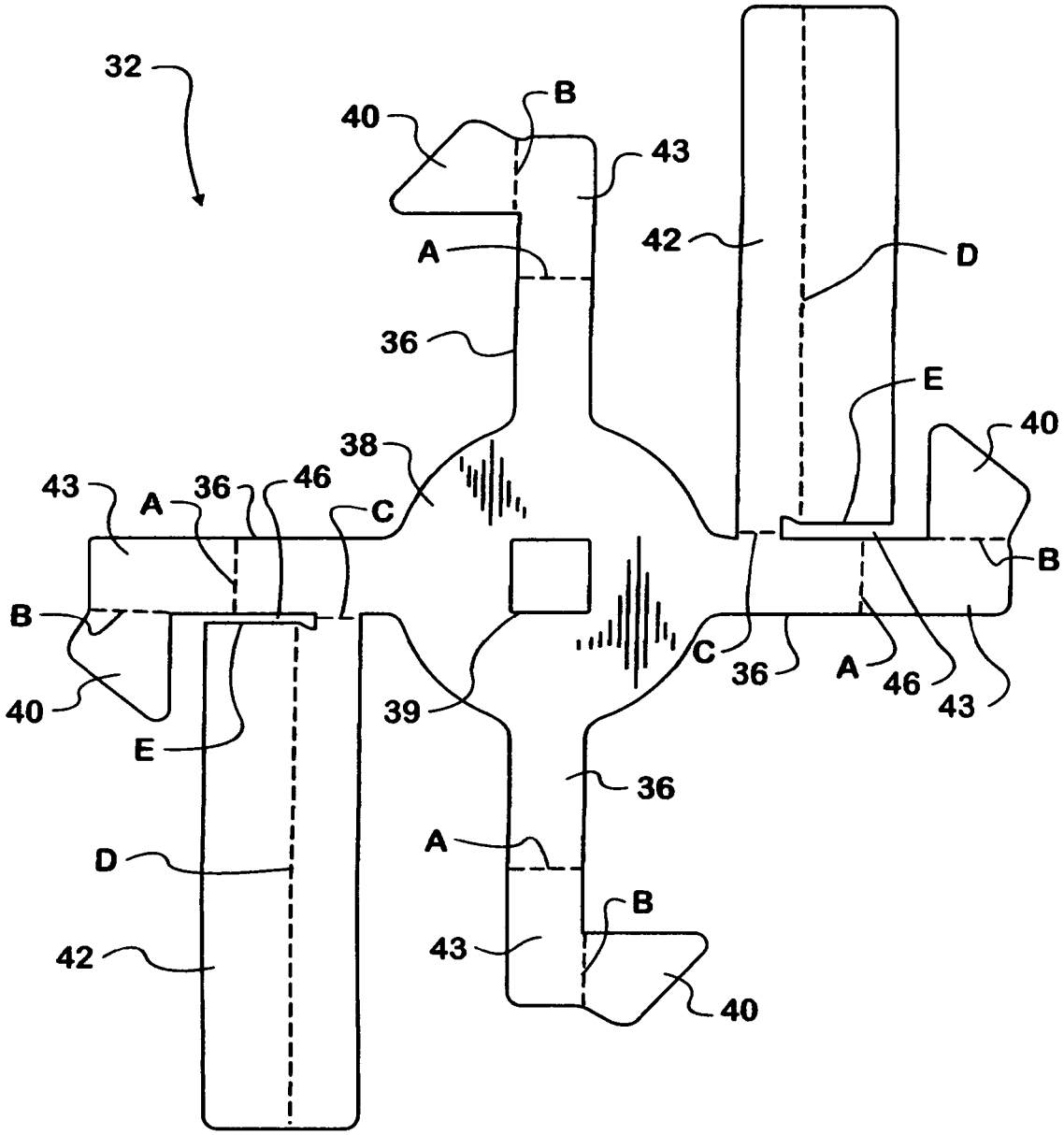
FIG. 3 shows a top plan view of an ice dispense agitator in an initial stage of manufacture, in which according to the method of the invention the agitator has been cut from flat metal stock.
Figure 4:
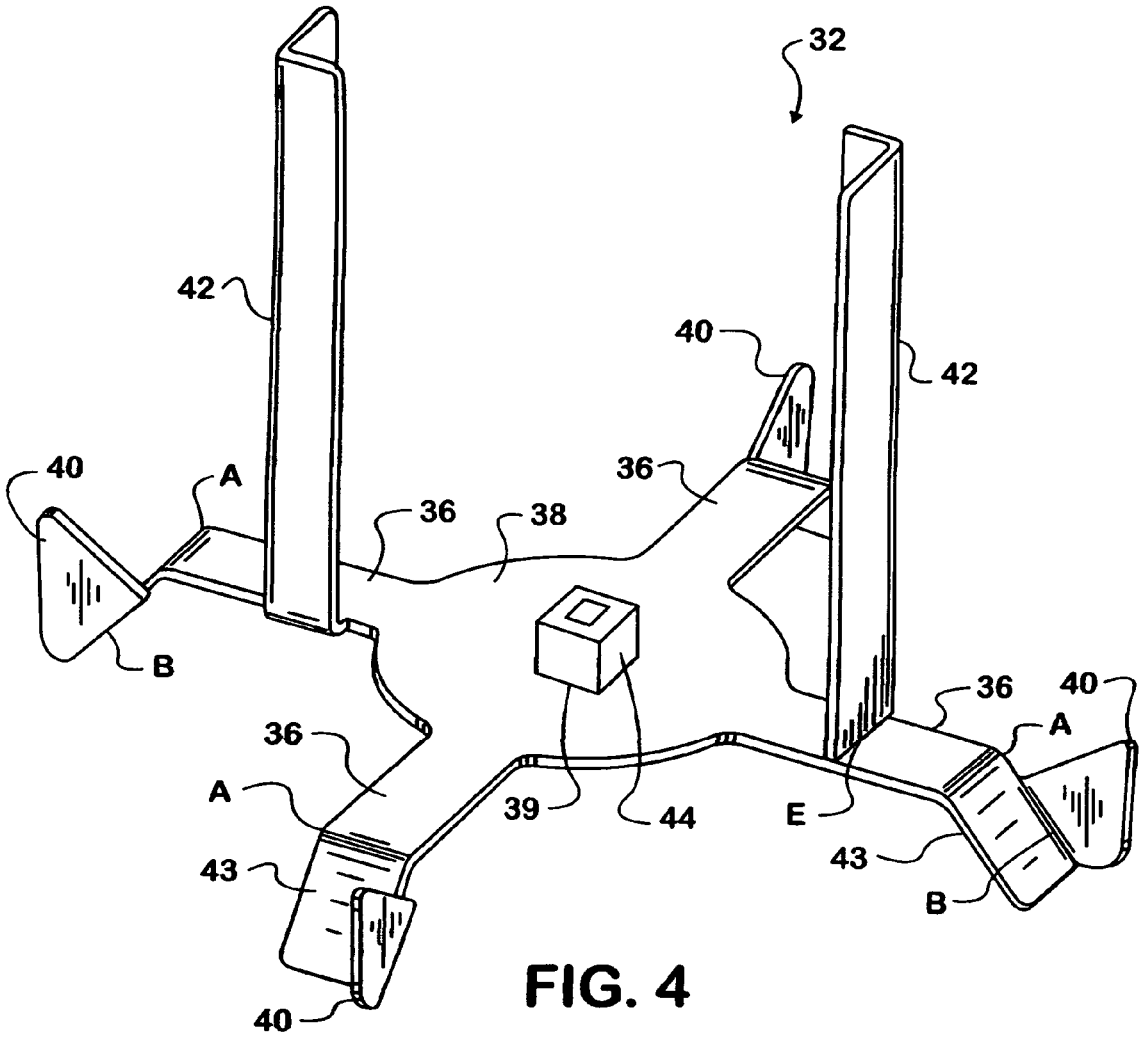
FIG. 4 is a perspective view of a completed ice dispense agitator made according to the method of the invention.

An understanding of the structure of and method of fabricating the ice dispense agitator 32 can be had by reference to FIGS. 3 and 4. The agitator is initially cut from flat metal stock as a one-piece or unitary structure, according to the pattern shown in FIG. 3. The sheet metal stock is selected to have sufficient thickness to provide the necessary robustness and strength for the agitator as finally manufactured. As cut from flat metal stock, the agitator 32 includes four generally rectangular ice sweeping arms 36 extending radially outward from a central generally circular hub portion 38 at angular spacings of about 90°. The hub is provided with a central square passage 39 at an axis of rotation of the hub, for receiving a complementary configured output shaft 45 of the drive motor 29. Each ice sweeping arm 36 terminates at its outer end in an ice moving paddle 40 that extends outward from a side of the arm generally perpendicular to a length of the arm. The shape of the ice moving paddles 40 is such that when fabrication of the agitator is complete and the agitator is mounted on the drive motor output shaft 45, the paddles will extend into and generally conform in shape to the ice bin ice directing trough 31.

In practice of the method of the invention, it is contemplated that any suitable technique may be employed to cut the agitator blank from flat sheet metal stock, as is readily understood by those skilled in the art. For example, among the various techniques that may be employed to fashion the agitator blank are metal stamping and CNC (computer numeric controlled) punching of the agitator from flat sheet metal stock; die cutting, including progressive tooling, of the agitator from sheet metal stock; band-saw or otherwise saw blade cutting the agitator from sheet metal stock; milling of sheet metal stock to form the agitator; and laser cutting, water jet cutting and plasma cutting the agitator from flat sheet metal stock.

As cut from flat metal stock, the ice dispense agitator 32 also includes two generally rectangular ice agitating blades 42 that are joined to the sides of associated diametrically opposed ice sweeping arms 36 and extend outward therefrom generally perpendicular to the length of the arms, although if desired or required an ice agitating blade could be provided for each ice sweeping arm. Each ice agitating blade 42 has a length extending generally perpendicular to and a width extending generally parallel to a length of its associated ice sweeping arm and is integrally joined to its associated ice sweeping arm along only a portion of its width. In particular, each ice agitating blade 42 is cut so that it is connected to its associated ice sweeping arm 36 only from an end of its width toward the central hub 38 to a point radially outward therefrom that is short of the full width of the blade. In consequence, an unconnected open area 46 then exists between an end edge portion E of the ice agitating blade and its associated ice sweeping arm outward from the radially outward point to the opposite end of the width of the blade, which end edge portion E extends along and adjacent the ice sweeping arm.

While not a physical part of the structure of the agitator 32 as initially cut from flat sheet metal stock, each ice sweeping arm 36 has a bend line A extending across its width generally medially of the length of the arm and a bend line B extending along its length between the side of the arm and its ice sweeping paddle portion 40, as represented in dashed lines. Each ice agitating blade 42 has a bend line C extending along its width and along the length of its associated ice sweeping arm at its juncture with the arm and a bend line D extending along its length just radially outward from the radially outer end of the bend line C, also as represented in dashed lines.

To form a finished ice dispense agitator 32 from the flat metal agitator blank depicted in FIG. 3, according to the method of the invention the flat metal agitator, the individual elements of which are initially coplanar, is subjected to bending operations. The outer end portions 43 of the ice sweeping arms 36 are bent downward along the bend lines A to an angle on the order of from about 45° to form angled end portions 43 and the paddle portions 40 are bent upward along the bend lines B to an angle of about 90° with the end portions 43 to form the paddles 40, such that the planes of the paddles then extend generally transverse to the planes of the remainder of the ice sweeping arms, including the planes of the angled portions 43. The shape of the paddles 40 and the angles of bend about the bend lines A and B are determined by the configuration of the ice bin trough 31, such that when the agitator is mounted on the drive motor output shaft 45 within the interior 25 of the ice bin 24, the angled arm portions 43 and the paddles 40 extend into, generally conform in shape to and freely sweep within and through the ice bin trough 31. The ice agitating blades 42, in turn, are bent along the bend lines C out of the plane of the ice sweeping arms 36 and to an angle on the order of about 90° with the ice sweeping arms, so that the blades then extend transverse to their associated ice sweeping arms. In addition, flange portions of the ice agitating blades 42 are bent along the bend lines D to an angle on the order of about 90° to form the ice agitating blades 42 to an "L" shape.

In practice of the method of the invention, it also is contemplated that any suitable technique may be employed to bend the agitator blank to the desired shape. For example, one such technique that may advantageously be used contemplates stamping the agitator from flat sheet metal stock and subjecting the resulting agitator blank to bending operations in the same process, so that the agitator is formed as a completed structure in a single process. Essentially, a blank of sheet metal would be placed into a forming/stamping die of a press, such that upon operation of the press the agitator is both cut and bent to proper shape, and is thus a finished part when removed from the press. However, while a "single step" manufacturing method may have certain advantages, it is within the contemplation of the method of the invention that the agitator be formed in a two step process, i.e., by first cutting an agitator blank from sheet metal stock and then bending the blank to the desired final shape. It is understood, of course, that the final shape need not necessarily be the same as that shown and described, and that the teachings of the invention are equally applicable to fabricating agitators to various other shapes that lend themselves to fabrication according to the method of the invention, as is understood and appreciated by those skilled in the art.

Upon completion of the bending process to form the ice dispense agitator 32 to its final shape, the ice agitating blades 42, which are integrally attached to the ice sweeping arms 36 along the bend lines C, are welded to the arms along their end edge portions E to fill the open unconnected area between the blades and arms with weld material that securely attaches the flange portions of the blades to the ice sweeping arms for enhanced strength and rigidity of the connection of the blades to the arms. In addition, a drive bushing 44 is welded to the agitator hub 38 over the square opening 39 to provide increased strength for the mechanical connection between the agitator and the drive shaft 45 of the agitator drive motor 29. The ice dispense agitator 32 can then be placed into the ice retaining bin 24 and attached to the drive motor shaft.

From the foregoing, it may be appreciated that manufacture of the ice dispense agitator 32 can be done quickly and with a minimum of operations, thereby greatly lowering the cost of fabricating the agitator. This represents a particular improvement over known agitators that are assembled and welded from a number of individual parts, since in fabricating the agitator 32, welds are required only to connect the end edge portions E of the ice agitator blades 42 to the adjacent ice sweeping arms 36, and to attach the drive bushing 44 to the agitator hub 38. As above mentioned, it is understood that while the invention has been described in connection with an ice dispense agitator having the configuration of the agitator 32, the teachings of the invention can be used with other agitator configurations, such as with agitators having four ice agitating blades 42 instead of two, with each blade then being attached to an associated one of the four ice sweeping arm 36.

While embodiments of the invention have been described in detail, various modifications and other embodiments thereof may be devised by one skilled in the art without departing from the spirit and scope of the invention, as defined in the appended claims.

What is claimed is:

1. A method of making an ice dispense agitator, comprising the steps of:

cutting a unitary agitator body from flat metal stock to provide the unitary agitator body with coplanar elements including a central hub having an axis of rotation, a plurality of elongate ice sweeping arms extending radially outward from the hub in angular spaced relationship, and at least one elongate ice agitating blade extending outward from a side edge of an associated ice sweeping arm;

bending a portion of an outer end of at least one ice sweeping arm to form an ice moving paddle on the outer end of the at least one ice sweeping arm; and bending the at least one ice agitating blade out of coplanar relationship with its associated ice sweeping arm, wherein said step of bending the at least one ice agitating blade brings the plane of the ice agitating blade into generally transverse relationship with the plane of the associated ice sweeping arm, and including the further step of bending the at least one ice agitating blade along its length to an L-shape, such that one leg of the L-shaped blade has an end edge portion that extends over and adjacent the associated one of the ice sweeping arms, and including the further step of welding the one edge portion to the associated ice sweeping arm.

2. A method of fabricating an ice dispense agitator, comprising the steps of:

cutting a unitary agitator body from flat metal stock to provide the unitary agitator body with coplanar elements including a central hub having an axis of rotation, a plurality of elongate ice sweeping arms extending radially outward from the hub in angular spaced relationship and having end portions and transverse extensions at the end portions, and at least one elongate ice agitating blade extending transversely from a side of an associated one of the ice sweeping arms intermediate the hub and the end portion of the associated ice sweeping arm and having an end edge portion that extends along and adjacent the side of the associated ice sweeping arm;

bending the end portion of each ice sweeping arm out of the plane of the part of the ice sweeping arm between the end portion and the central hub;

bending the transverse extension of each ice sweeping arm out of the plane of the end portion of the ice sweeping arm; and bending the at least one ice agitating arm out of the plane of its associated ice sweeping arm.

3. A method as in claim 2, wherein said unitary agitator body has an upper surface, said step of bending the end portion of each ice sweeping arm bends the end portion downward out of the plane of the part of the ice sweeping arm between the end portion and the central hub, said step of bending the transverse extension of each ice sweeping arm bends the transverse extension upward out of the plane of the end portion of the ice sweeping arm, and said step of bending the at least one ice agitating blade bends the at least one ice agitating blade upward out of the plane of its associated ice sweeping arm.

4. A method as in claim 3, wherein said step of bending the end portion of each ice sweeping arm bends the end portion downward on the order of about 30° to 60° out of the plane of the part of the ice sweeping arm between the end portion and the central hub.

5. A method as in claim 3, wherein said step of bending the transverse extension of each ice sweeping arm bends the transverse extension upward on the order of about 90° out of the plane of the end portion of the ice sweeping arm.

6. A method as in claim 3, wherein said step of bending the at least one ice agitating blade bends the at least one ice agitating blade upward on the order of about 90° out of the plane of its associated ice sweeping arm.

7. A method as in claim 2, wherein said at least one ice agitating blade comprises a plurality of ice agitating blades, each extending transversely from a side of an associated one of the ice sweeping arms.

8. A method as in claim 2, including the further step of bending the at least one ice agitating blade along its length to be L-shaped, such that the bent leg of the L-shaped blade has the end edge portion and the end edge portion extends along and adjacent the associated one of the ice sweeping arms, and including the further step of welding the end edge portion to the associated ice sweeping arm.

* * * * *